United States Patent [19]

Ålund

[11] 4,046,493

[45] Sept. 6, 1977

[54] SLIDING VANE MACHINE

[76] Inventor: Torsten Ålund, Persgatan 9 B, Goteborg, Sweden, 416 58

[21] Appl. No.: 678,495

[22] Filed: Apr. 20, 1976

[30] Foreign Application Priority Data

Apr. 21, 1975 Sweden ..... 7504554

[51] Int. Cl.[2] ..... F04B 49/08; F03C 3/00

[52] U.S. Cl. ..... 417/220; 418/22; 418/28; 418/219

[58] Field of Search ..... 417/222, 220; 418/16, 418/22, 28, 217, 219

[56] References Cited

U.S. PATENT DOCUMENTS

| | | | |
|---|---|---|---|
| 3,937,605 | 2/1976 | Karpisek | 418/219 |

FOREIGN PATENT DOCUMENTS

| | | | |
|---|---|---|---|
| 122,424 | 10/1927 | Switzerland | 418/22 |
| 657,991 | 10/1951 | United Kingdom | 418/28 |
| 8,675 | 4/1912 | United Kingdom | 418/28 |

*Primary Examiner*—Carlton R. Croyle
*Assistant Examiner*—Leonard Smith
*Attorney, Agent, or Firm*—Holman & Stern

[57] ABSTRACT

In a sliding vane machine a work can be accomplished by a pressure fluid rotating a rotor provided with a plurality of sliding vanes, which function as turbine blades, whereby the work is taken out as a rotational motion at the rotor shaft. If the machine is designed as a pump the shaft is rotated and the vanes act as impeller blades.

In both cases it is desirous if the machine can adapt its work in response to varying loads.

In accordance with the invention this is achieved by providing the machine with pressure plates controlling the effective working area of said vanes, the pressure plates thereby being adjusted by a fluid pressure which by means of a pressure actuated valve can be varied the pressure-actuated valve itself being controlled by the fluid pressure in a conduit supplying the pressure fluid to the machine.

4 Claims, 6 Drawing Figures

SLIDING VANE MACHINE

BACKGROUND OF INVENTION

The present invention relates to sliding vane machines comprising in combination a housing, a rotor being rotatable therein, a plurality of axial grooves spaced evenly along the circumference of said rotor, each one of said grooves supporting two vanes, which vanes are axially displaceable in said groove between a first position in which they are entirely contained inside said groove, to a second position in which each separate vane projects axially from the rotor, a number of radially extending partition walls fixed in the housing and dividing the interior thereof into a plurality of pressure chambers, guide means in the housing adapted to bring said vanes to their said first position when a groove during the rotational movement of the rotor passes one and each of said partition walls, a fluid inlet in each one of said pressure chambers, a fluid supply line common for all fluid inlets, a fluid outlet in each one of said pressure chambers, a fluid discharge conduit common for all fluid outlets.

Machines of this kind can be used as a motor, whereby the pressure chambers are fed with a pressure fluid, the work of the motor thereby being taken out via the rotor shaft. It is also possible to use the machine as a pump, whereby the rotor shaft is rotated and the rotor is thereby brought to displace the fluid.

In both cases is it desirable that the working characteristics of the machine can be altered during operation in order to be adpated to varying external loads or according to varying performance demands respectively.

SUMMARY OF THE INVENTION

The invention refers to a control device by means of which an automatic control of the displacement of the sliding vane machine can be obtained and this is achieved by a combination comprising a pressure plate arranged axially displaceable at each axial side of said rotor and in engagement with the ends of the said vanes projecting from the said groove when the vanes are in their said second position, a number of slots arranged in said pressure plates for said partition walls, the axial position of said pressure plates being adjustable following pressure variations in a fluid-containing first space between the pressure plate surface remote from the said vanes and the adjacent end wall of the housing, and a pressure-actuated sliding valve adapted to control the fluid pressure in said space.

DESCRIPTION OF THE PREFERRED EMBODIMENT

Figure 1:
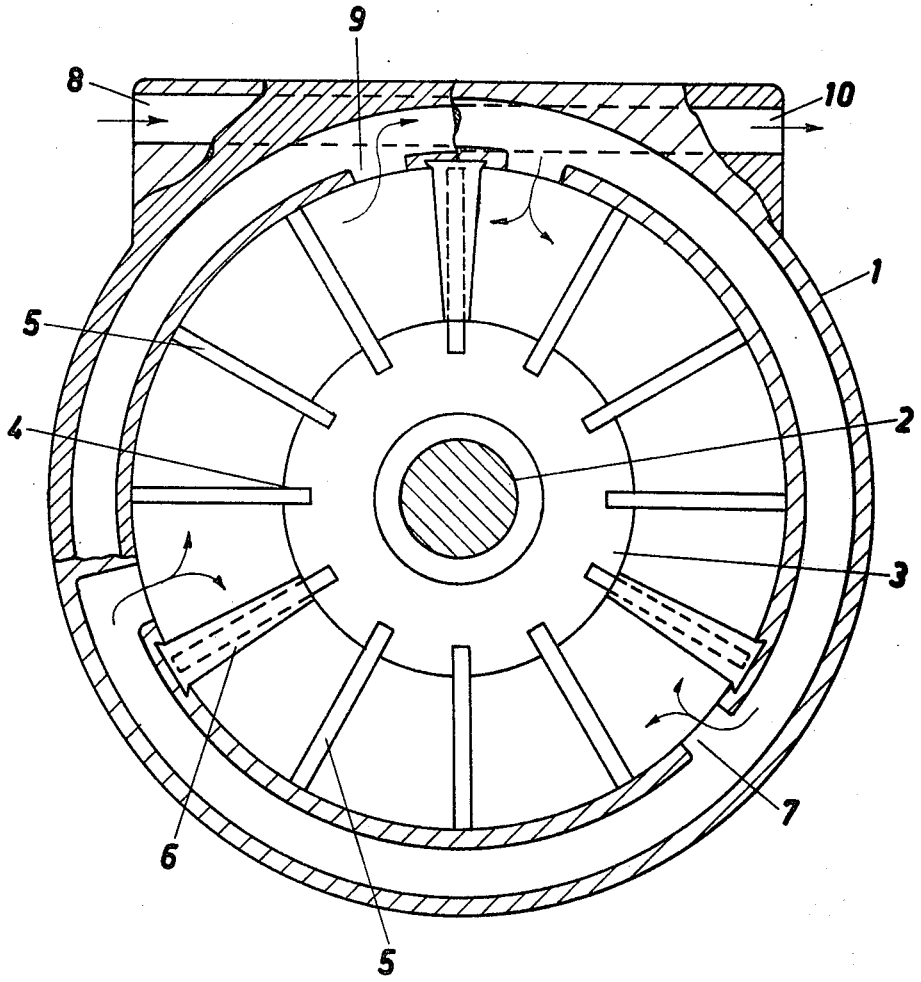
FIG. 1 shows schematically and in two different sections perpendicularly to the rotor shaft a sliding vane machine of the kind in question.

FIG. 1 shows schematically in sections perpendicular to the rotor shaft of the sliding vane machine the design of the machine. This comprises a substantially cylindrical housing 1, which for elucidatory reasons in the figure has been shown in two different sections which are parallel to each other, and where the two different section surfaces have been shown by different cross-hatching. A shaft 2 is rotatably supported in the housing 1 and said shaft having fixed thereto a rotor 3, which, as can be better seen in FIG. 2, has an intermediate portion of substantially the same outer diameter as the inner diameter of the housing, and two comparatively slender end portions located one at each side of the intermediate portion and each having a smaller outer diameter than the inner diameter of the housing. Along the circumference of the rotor there is arranged with an even pitch, a number of axially extending grooves 4 — in the example shown 12 grooves — and in each one of these grooves there is arranged two vanes 5, which are separately axially displaceable. The vanes 5 extend radially to the wall of the housing 1 and slide sealingly against this. Along the circumference of the housing there are fixed with equal spaces a number of radial, firm partition walls 6 — in the example shown three partition walls — each of which consists of two wall portions located one at each side of the intermediate portion of the rotor and each one sealing off the space between the said intermediate portion of the rotor, the internal circumference of the housing and the end wall of the housing thus that the housing is divided into a corresponding number of pressure chambers. Each pressure chamber is provided with a fluid inlet 7, which communicates with a supply line 8 common for all pressure chambers. Each pressure chamber further has a fluid outlet 9, which outlets all communicate with a common discharge conduit 10. The inlet 7 for each pressure chamber is thereby located at the front end of the pressure chamber as seen in the rotational direction, whereas the outlet 9 is located at the end of the chamber and in such a manner that at least one pair of vanes at all times blocks the inlet 7 from having direct connection with the pertaining outlet 9.

Figure 2:
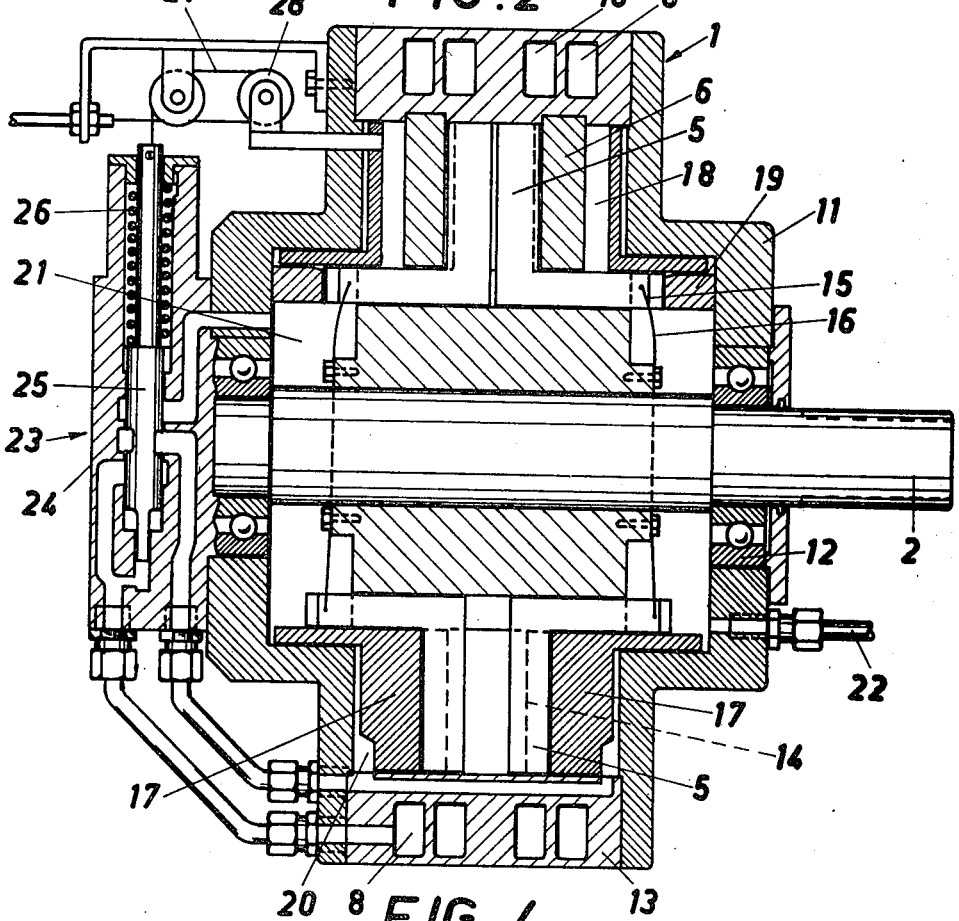
FIG. 2 shows a diametrical section of the sliding vane machine according to FIG. 1.

FIG. 2 shows in a diametrical section in of FIG. 1 more detailed structure of the sliding vane machine and particularly its control device, which is not shown in FIG. 1. The machine housing 1 is in the example shown built as two substantially circular housing end walls 11, each of which is provided with seats for rolling bearings 12, in which the rotor shaft 2 is supported. The two housing end walls 11 are secured together by means of an annular housing portion 13 with which the end walls form a closed space. The supply line 8 and the discharge conduit 10, are both arranged in the annular housing portion 13. As is shown particularly at the lower portion of FIG. 2 the rotor 3 has an intermediate portion shown with dotted lines 14, which portion extends to the internal wall of the housing portion 13. The axial measure for this rotor portion is somewhat larger than the total axial measure of the radial portions of two vanes and it is substantially equal to the distance between two fixed partition wall portions 6, which are framed in the annular housing portion 13. On each side of the intermediate rotor portion there is a rotor portion having a smaller diameter. The vanes 5 which are located in pairs in each one of the axially extending grooves of the rotor, are substantially L-shaped and invertedly L-shaped, respectively. The two web portions of this pair of L-bodies extend radially outwards to sealingly sliding contact against the internal surface of the annular housing portion 13 and the base portions of the L-bodies are arranged in opposite directions. The base portions of the vanes are slidingly fitted in the axially extending grooves of the rotor. The base portion of the vane at its end turned outwards is provided with a sliding shoe 15 against which a spring 16, which is fixed to the rotor exerts an outwardly directed force. At each side of the rotor, between the vane 5 and the end wall 11 of the housing there is arranged an annular pressure plate 17. These pressure plates are secured against rotation relative to the housing and act as sliding surfaces for the vanes. The pressure plates are provided with slots 18 intended for the fixed partition walls 6 and located just in front of them. At the wall of the housing 1 just in front of said fixed partition walls there are futhermore fitted guide means which for instance can be fixed cams 19, which are arranged to act upon the outwardly turned sliding shoes 15 of the vanes during rotation, thus that each pair of vanes is pushed entirely into its groove in the intermediate portion of the rotor, i.e. between the fixed partition wall portions, when these are passed. The spring 16 hereby urges the vane out to correct working position as soon as the cam 19 has been passed.

Between each pressure plate 17 and the housing end wall 11 adjacent thereto there is a free space 20, which spaces 20 are all in free mutual connection. There is also a space 21, which is spaced apart from the space 20 and located nearest to the rotor shaft and this space 21 is via a drainage opening 22 connected to the ambient atmosphere.

At one of the housng end walls 11 there is mounted a control device adapted to exert such a control on the machine that an obedient machine work is obtained in accordance with varying outer loads, and the control device comprises mainly a sliding valve 23 having a valve body 25, which is displaceable in a valve housing 24, and which valve body is biased in one direction by means of a spring 26. The valve housing has three channels, which communicate with the supply line 8, where a high pressure prevails, with the space 20 between the pressure plate and the housing end wall and with the space 21 with a substantially zero pressure. The valve housing channel from the supply line is branched off to a space where it actuates the valve body 25 in a direction opposite to that of the spring 26. The remote end of the valve body is fitted to one end of an actuating member 27, which can be for instance a bowden cable, which runs via a firmly mounted pulley to second pulley 28, which is connected to one of the pressure plates 17 and from there further to a manually adjustable, actuating means which is not shown. Due to this external adjustment possibility the function of the valve can be modified thereby that the biasing spring force can be altered. The device is shown in its neutral position, i.e. where the rotor shaft works at a steady load, which is set at the manual actuating means. In this position the pressure from the line 8 and the force of the spring 26 balance each other thus that the valve body 25 is at rest in a position where the mutual connections between the three channels of the valve housing are all blocked.

Figure 3:
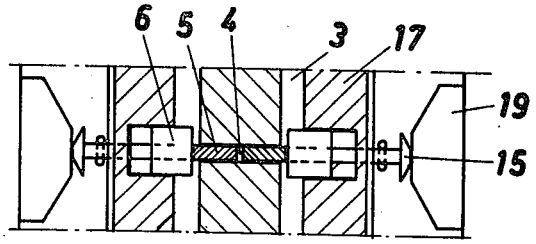
FIG. 3 is an elevation in peripheral direction as seen from the outside of a portion of the internal parts of the machine taken in level with one of the fixed partition walls.
Figure 4:
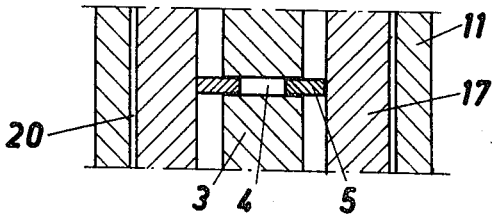
FIG. 4 shows a corresponding elevation of a portion taken in level with an axially extending groove in the rotor.

FIGS. 3 and 4 show schematic elevations seen from the inner side of the annular housing portion 13 and in towards the rotor shaft and the figures show peripheral parts of the machine as seen in the plane shown in FIG. 2. From FIG. 3 it is seen how a pair of vanes are entirely pushed into a groove in the intermediate portion of the rotor 3 when the fixed partitions are passed and in FIG. 4 it is shown how a pair of vanes 5 engage against the pressure plate 17 in the areas where the vanes are brought out to their working positions.

Figure 5:
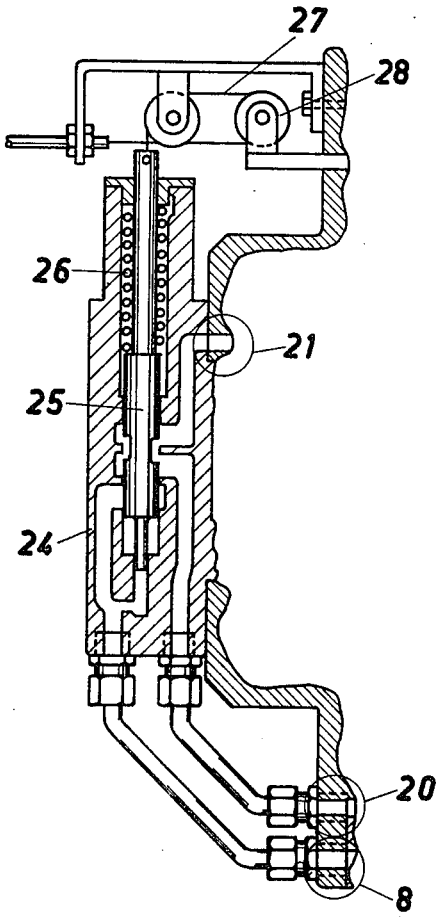
FIG. 5 shows the control device for the sliding vane machine in one alternative position.

FIG. 5 shows the control device of the sliding vane machine in a position where the load on the rotor shaft increases. Due to the increase in work which hereby must be executed by the fluid in order to rotate the rotor also the pressure in the supply line 8 will increase. Hereby also the pressure which counteracts the biasing force on the valve body 25 will increase and the valve body therefore moves against the action of the spring, unitl the space 20 is brought in connection with the space 21, which communicates with the ambient atmosphere.

Figure 6:
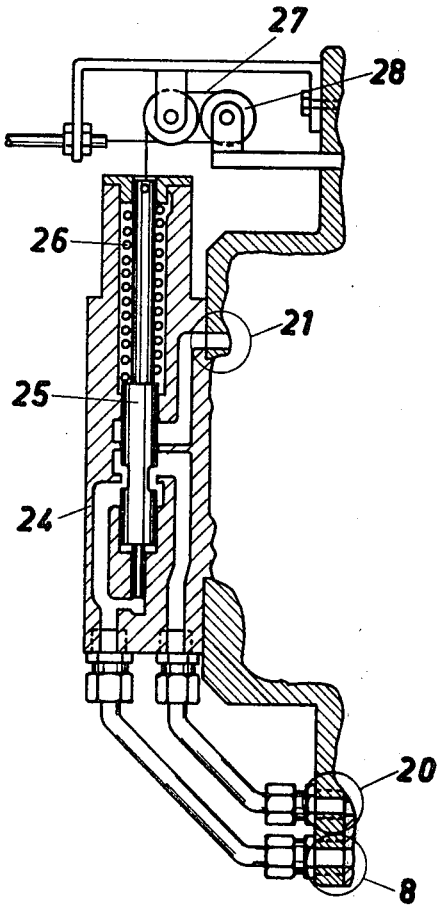
FIG. 6 shows in a view corresponding to FIG. 5 a further position of the control device.

In FIG. 6 is finally shown the reverse condition in relation to FIG. 5, i.e. the load on the output shaft — the rotor shaft 2 — decreases. Hereby there will occur pressure drop in line 8 and the spring 26 will urge the valve body 25 past its neutral position and to a position in which line 8, which as mentioned before contains fluid under pressure, is connected to space 20 between the pressure plates and the housing end walls 11.

OPERATION

The sliding vane machine according to the embodiment shown has the following function. When the moment on the shaft 2 as earlier mentioned increases there will also be an increase in the oil pressure in the supply line 8 and hereby the valve body 25 is displaced thus that the space 20 between the pressure plates 17 and the housing wall 11 will be connected to the space 21 in the interior of the machine which space in principal has zero pressure and communicates with the ambient atmosphere via the opening 22. The pressure fluid which thereby is contained between the pressure plates and the housing walls will be led off through space 21 and the opening 22 and due to the pressure, which acts on the pressure plates, from the pressure oil acting on the vanes, the pressure plates will move outwards against its adjacent housing end wall 11. Hereby the active working surface of the vanes will increase whereby the rotational moment in correspondance therewith increases at the same time as the rotational speed in reversed proportion thereto decreases.

When the moment on the shaft decreases the valve body 25 will first take up its neutral position where all channels are mutually blocked from each other and thereby preclude contact between anyone of spaces 8, 20 and 21. When the moment on the shaft has been further reduced thus that the oil pressure in the supply line 8 is lower than the pressure from the spring 26 the valve body 25 will be displaced by the spring until its alternative position is reached where the high pressure supply line 8 will be connected to the space 20 between the pressure plates and the housing walls. The pressure plates hereby are urged inwards against each other whereby the vanes 5 are pushed further into the grooves in the intermediate portion of the rotor. Hereby the active working surface of the vanes will be reduced and the rotational moment is decreased at the same time as the speed of the rotor increases. In this way the motor will give a constant output effect no matter of variations in the rotational speed of the rotor.

The rotational speed can furthermore be manually influenced by adjustment of the not shown actuating means. In order to reduce the rotational speed the Bowden cable 27 hereby is stretched. Hereby the pulley 28 which is attached to the pressure plate 17 will tend to pull the pressure plate in its own direction. The pressure plate will however be retained in its temporary position by means of the pressure fluid in the space 20, whereby the pull of the cable instead will be transferred to the valve body 25, which against action of spring 26 will be pulled to the position in which the space 20 is put in connection with the low pressure space 21, whereby the space 20 is evacuated. When the pressure plate hereby moves outwards (and reduces the breadth of the space 20) the pulling force set on the manual actuating means will be reliefed and the pull on the valve body 25 will be so much reduced that the valve body urged by spring 26 can resume it neutral position. The same function will arise from this manipulating as if the fluid pressure in the supply line 8 of the machine increases and a reduced rotational speed is obtained. If the manually operated actuating means is adjusted so that the cable will be longer the valve body 25, if the fluid pressure in the supply line 8 is not too high, can be moved by the spring 26 thus that the space 20 is connected to the high pressure space 8 and the space 20 is hereby set under pressure. The pressure plates will hereby move inwards and the pulley 28 will stretch the cable thus that the valve body 25 is drawn against its neutral position and the movement stops. In this position the machine still can react as earlier described if the fluid pressure increases, i.e. if the working moment of the shaft increases. The rotational speed of the motor and the rotational moment are thus dependent on the position of the manual actuating means and on the fluid pressure.

If the sliding vane machine according to the invention shall work as a pump the control valve is modified thus that the connections for the channels from the high pressure space 8 and the low pressure space 21 change place. The cable for the manual actuating means is furthermore drawn in another way as the movement of the pressure plates at an altered pressure will be opposite the movements obtained when the machine works as a motor. When the sliding vane machine works as a pump there will be obtained a constant pump pressure thereby that the machine automatically increases or reduces the oil volume pumped in relation to the tendencys of altered pressure. The maximum oil volume pumped is furthermore decided by manual adjustment.

The invention is not limited to the embodiment shown in the drawings and described in connection thereto but can be modified in several ways within the scope of the appended claims.

What I claim is:

1. A sliding vane machine comprising in combination a housing, a rotor being rotatable therein, a plurality of axial grooves spaced evenly along the circumference of said rotor, each one of said grooves supporting two vanes, which vanes are axially displaceable in said groove, between a first position in which they are entirely contained inside said groove, to a second position in which each separate vane projects axially from the rotor, a number of radially extending partition walls fixed in the housing and dividing the interior thereof into a plurality of pressure chambers, guide means in the housing adapted to bring said vanes to said first position when a groove, during the rotational movement of the rotor, passes one and each of said partition walls, a fluid inlet in each one of said pressure chambers, a fluid supply line common for all fluid inlets, a fluid outlet in each one of said pressure chambers, a fluid discharge conduit common for all fluid outlets, a pressure plate arranged axially displaceable at each axial side of said rotor and in engagement with the ends of the said vanes projecting from the said groove when the vanes are in their said second position, a number of slots arranged in said pressure plates for said partition walls, the axial position of said pressure plates being adjustable following pressure variations in a fluid-containing first space between the pressure plate surface remote from the said vanes and the adjacent end wall of the housing, and a pressure-actuated sliding valve body, slidingly arranged in a valve housing provided with a first conduit between the interior of the valve housing and said fluid-containing first space, a second conduit between the interior of the valve housing and a second low pressure space and a third conduit between the interior of the valve housing and a third, high pressure space connected to said supply line, said sliding valve body being displaceable in said valve housing to alternatively connect the said first conduit with either one of said second and said third conduits, for controlling fluid pressure in said first space.

2. A sliding vane machine as claimed in claim 1, wherein the siding valve is biased in one direction and urged in the opposite direction by the transient pressure in the said common fluid supply line, the sliding valve including control means adapted to connect the said first space alternatively with said second space having a low pressure and the third space having a high pressure all following variations in the fluid pressure in said common fluid supply line, the sliding valve thus controlling the axial positions of the pressure plates and thereby the size of the temporary working surface of the vanes.

3. A sliding vane machine as claimed in claim 2 wherein the sliding valve includes means arranged to block the connections between said first, second and third spaces in its neutral working position, where the biasing force and the fluid pressure in the common fluid supply line balance each other.

4. A sliding vane machine as claimed in claim 2 wherein there are provided means for manual adjustment of the biasing force acting on said sliding valve.

* * * * *